US008888200B2

(12) United States Patent
Sato

(10) Patent No.: US 8,888,200 B2
(45) Date of Patent: Nov. 18, 2014

(54) SLIDE ASSIST MECHANISM AND DRAW-IN UNIT

(75) Inventor: Masakazu Sato, Tokyo (JP)

(73) Assignee: Nifco Inc., Yokohama-Shi (JP)

( * ) Notice: Subject to any disclaimer, the term of this patent is extended or adjusted under 35 U.S.C. 154(b) by 246 days.

(21) Appl. No.: 13/380,794

(22) PCT Filed: Jun. 24, 2010

(86) PCT No.: PCT/JP2010/060789

§ 371 (c)(1),
(2), (4) Date: Feb. 6, 2012

(87) PCT Pub. No.: WO2010/150863

PCT Pub. Date: Dec. 29, 2010

(65) Prior Publication Data

US 2012/0124778 A1 May 24, 2012

(30) Foreign Application Priority Data

Jun. 24, 2009 (JP) ..... 2009-149779

(51) Int. Cl.

| | |
|---|---|
| ***A47B 95/02*** | (2006.01) |
| ***E05F 5/02*** | (2006.01) |
| ***E05F 5/00*** | (2006.01) |
| *E05F 1/16* | (2006.01) |

(52) U.S. Cl.

CPC ..... *E05F 5/027* (2013.01); *E05F 5/003* (2013.01); *E05F 1/16* (2013.01); *E05Y 2800/00* (2013.01); *E05Y 2201/412* (2013.01); *E05Y 2201/424* (2013.01); *E05Y 2800/73* (2013.01)

USPC ..... 312/319.1; 312/333

(58) Field of Classification Search

USPC ..... 312/319.1, 333, 334.7, 334.8, 334.44, 312/334.46, 334.47

See application file for complete search history.

(56) References Cited

U.S. PATENT DOCUMENTS 5,474,375 A * 12/1995 Hollenstein et al. ..... 312/319.1
7,077,487 B2 * 7/2006 Yang ..... 312/333

(Continued)

FOREIGN PATENT DOCUMENTS

JP H11-210310 8/1999
JP 2003-214023 7/2003

(Continued)

OTHER PUBLICATIONS

Japanese Patent Office, "Office Action for JP2009-149779", Dec. 4, 2012.

*Primary Examiner* — Matthew Ing
(74) *Attorney, Agent, or Firm* — Manabu Kanesaka

(57) ABSTRACT

A slide assist mechanism includes a case attached to one of a main body or a moving body; a slider disposed freely slidably in the case; a latch supported by the slider so as to be switched between a standby position which locks in a corresponding portion of the case and a draw-in position which releases the locking; a draw-in unit including an urging device; and an operation member attached to the another of the main body or the moving body and switching the latch from the standby position to the draw-in position, or switching the latch from the draw-in position to the standby position. When the latch is switched from the standby position to the draw-in position, due to an urging force which has been accumulated in the urging device, the slide assist mechanism allows the moving body to move from a first position to a second position on a main body side through the operation member. In the slider, the urging device is disposed on a lower surface side, and also one end in a sliding direction includes an attachment device for the urging device.

10 Claims, 12 Drawing Sheets

(56) References Cited

U.S. PATENT DOCUMENTS

| | | | | |
|---|---|---|---|---|
| 7,244,005 | B1 * | 7/2007 | Lu | 312/333 |
| 7,374,260 | B2 * | 5/2008 | Lu | 312/333 |
| 7,374,261 | B1 * | 5/2008 | Wang | 312/333 |
| 7,399,041 | B2 * | 7/2008 | Prentner et al. | 312/333 |
| 8,083,304 | B2 * | 12/2011 | Hu | 312/333 |
| 8,496,306 | B2 * | 7/2013 | Chen et al. | 312/333 |
| 8,590,989 | B2 * | 11/2013 | Lowe | 312/319.1 |
| 2007/0132346 | A1 * | 6/2007 | Huang | 312/333 |
| 2009/0160299 | A1 * | 6/2009 | Chen et al. | 312/334.44 |

FOREIGN PATENT DOCUMENTS

| | | |
|---|---|---|
| JP | 2005-023615 | 1/2005 |
| JP | 2006-029564 | 2/2006 |
| JP | 2006-299578 | 11/2006 |
| JP | 2007-016521 | 1/2007 |
| JP | 2007-107301 | 4/2007 |
| JP | 2007-255018 | 10/2007 |
| JP | 2008-144567 | 6/2008 |
| JP | 2008-149908 | 7/2008 |
| JP | 2009-127293 | 6/2009 |
| WO | WO2005/068760 | 7/2005 |

* cited by examiner

Prior Art

SLIDE ASSIST MECHANISM AND DRAW-IN UNIT

RELATED APPLICATIONS

The present application is National Phase of International Application No. PCT/JP2010/060789 filed Jun. 24, 2010, and claims priority from Japanese Application No. 2009-149779, filed Jun. 24, 2009.

FIELD OF TECHNOLOGY

The present invention relates to a slide assist mechanism which assists an operation switching a moving body from a first position to a second position, or from the second position to the first position on a main body side by using an urging force.

BACKGROUND ART

FIGS. 12(*a*) and 12(*b*) show a slide assist mechanism of Patent Document 1. In the example, a main body is disposed to freely slide a sliding door; a projection body 9 which is an operation member is provided in the sliding door; and the sliding door is drawn in through the projection body 9 by a draw-in unit which is an essential portion of the slide assist mechanism provided in the main body. The draw-in unit comprises a case 1 attached to the main body; sliders 2A and 2B disposed freely slidably in the case 1; latches 5 and 5 rotatably supported through a shaft 8 relative to each slider; and urging devices 3. The projection body 9 is provided to project on an upper end surface of the sliding door.

Here, the case 1 is required to be slender and also thin due to a relation wherein the case 1 is disposed along a guide rail on the main body side. Also, each slider 2A and 2B, and the latch 5 are disposed so as to be stabilized and excellent due to the following structure relative to the case 1. Specifically, each projected portion 22 provided on upper and lower surfaces is fitted in guide grooves 12*b* and 16*b* provided on the upper and lower surfaces of the case 1, and each slider slides while the slider is guided by a guide device on upper and lower sides. Also, each latch 5 slides while each projection 52 provided on the upper and lower surfaces is being guided by guide grooves 14 and 19 provided on the upper and lower surfaces of the case 1. Each of guide grooves 14 and 19 respectively comprises a straight-line groove 14*a* and 19*a* parallel to the guide groove 12*b* and 16*b*; and an approximately L-shaped locking groove 14*b* and 19*b* provided on both sides of the straight-line groove 14*a* and 19*a*.

In the aforementioned slide assist mechanism, both-side latches 5 in FIG. 12(*a*) and the right-side latch 5 in FIG. 12(*b*) are in a standby position. In the standby position, the up and down projections 52 are locked in the corresponding locking grooves 14*b* and 19*b*, so that a position of the latch 5 is controlled against an urging force accumulated in the urging devices 3 together with the slider 2A. Then, from the state in FIG. 12(*a*), when the sliding door, which is in an open position on the left side which is not shown in the figures, is operated to slide from an opening direction to a closing direction, the projection body 9 hits an inner surface of a hook portion 50 of the latch 5 of the draw-in unit wherein the projection body 9 corresponds, so that the latch 5 is rotated due to stress thereof so as to be switched from the standby position to a draw-in position as shown on the left side of FIG. 12(*b*). In the draw-in position, in a state wherein the latch 5 holds the projection body 9 inside the hook portion, the up and down projections 52 enter in the straight-line grooves 14*a* and 19*a* from the locking grooves 14*b* and 19*b* so as to release the locking. Consequently, the latch 5 and the slider 2A are slid by the urging force accumulated in the urging device 3 so as to automatically switch the sliding door to a closed position through the projection body 9. Also, from the closed position, when the projection body 9 is slid to the left side of the figures together with the latch 5 due to an opening operation of the sliding door, along with this, an urging force is accumulated in the urging device 3. Furthermore, when the sliding door is moved in the opening direction, an urging force is accumulated again so as to switch the latch 5 to the standby position.

PRIOR ART DOCUMENT

Patent Document

Patent Document 1: Japanese Unexamined Patent Publication No. 2008-144567

SUMMARY OF THE INVENTION

Problems to be Solved by the Invention

In the slide assist mechanism, when the sliding door is operated to be closed, due to the urging force of the urging device, the sliding door is automatically switched up to the closed position from a middle of a closing operation to prevent an occurrence of an incomplete closed state of the sliding door. However, in the conventional mechanism, if a coil spring is used as the urging device, a handling property or an assured urging force can be easily provided. On the other hand, for example, in a draw-in process, an urging force in an early phase differs substantially from an urging force just before a final phase, and due to that, a sliding property can be easily damaged. As a measure for this, in addition to reducing a sliding speed of the slider by a braking device, a usage coil spring whose entire size is made as long as possible is used.

Specifically, as a preferable coil spring, in a case of the example in FIGS. 12(*a*) and 12(*b*), in a state wherein the urging force is released, the entire size of the spring should be set to the longest size by conforming to a distance between a left end of the left-side slider 2A and a right end of the right-side slider 2B. However, if such coil spring is used, the latch can be easily interfered with the coil spring, and also concerning the guide device (a structure fitting the aforementioned up and down projections 52 and 52 in the guide grooves 14 and 19 on the upper and lower surfaces of the case) guiding a position to switchover the latch, the projections and the guide grooves positioned on a coil spring side have to be omitted. Incidentally, as a measure for the above, the aforementioned problem can be solved by enlarging the case, and separating the latch from the coil spring so as not to buffer. However, in this case, flat downsizing becomes difficult so as to be difficult to be adopted.

An object of the present invention is to solve the aforementioned problems, and even in a case where the coil spring whose entire size is long is used as the urging device, an operation property, simplification, and the flat downsizing can be maintained, or easily improved.

Means for Solving the Problems

According to the first aspect of the present invention, there is provided a slide assist mechanism comprising a case attached to one of a main body or a moving body; a slider disposed freely slidably in the case; a latch supported by the slider so as to be switched between a standby position which locks in a corresponding portion of the case and a draw-in position which releases the aforementioned locking; a draw-in unit comprising an urging device; and an operation member attached to another of the main body or the moving body and switching the latch from the standby position to the draw-in position, or switching the latch from the draw-in position to the standby position. When the latch is switched from the standby position to the draw-in position, due to an urging force which has been accumulated in the urging device, the slide assist mechanism allows the moving body to move from a first position to a second position on a main body side through the operation member. In the slider, the urging device is disposed on a lower surface side, and also one end in a sliding direction includes an attachment device for the urging device.

Preferably, the slider includes a spring placement portion provided along a longitudinal direction on the lower surface side, wherein a coil spring which is the urging device is placed; a latch placement portion wherein one portion on the lower surface side is provided in a reversed concave shape so as to place the latch; and an escape groove dividing the latch placement portion and provided in an upper wall portion. Preferably, the latch has a thickness so as to be nearly housed in the latch placement portion, and includes an engaging portion engaging with and disengaging from the operation member; and a projection fitted in a guide groove provided on an upper surface side of the case through the escape groove. In this case, since the slider includes the spring placement portion wherein the coil spring which is the urging device is placed along the longitudinal direction on the lower surface side, and at the same time, one portion on the lower surface side of the latch placement portion is provided in the reversed concave shape, a width of the case is allowed to be set according to a width of the slider so as to be capable of realizing flat downsizing further. Also, in a state wherein the latch is placed in the latch placement portion including the reversed concave shape, the projection is fitted in the guide groove on the upper surface side of the case from the escape groove, so that a guide device provided between the latch and the upper surface of the case shown in the Patent Document 1 can be adopted. Thereby, while maintaining an excellent operation property, simplification can be also obtained.

According to the second aspect of the present invention, there is provided the slide assist mechanism comprising the case attached to one of the main body or the moving body; the slider disposed freely slidably in the case; the latch supported by the slider so as to be switched between the standby position which locks in the corresponding portion of the case and the draw-in position which releases the aforementioned locking; the draw-in unit comprising the urging device; and the operation member attached to another of the main body or the moving body and switching the latch from the standby position to the draw-in position, or switching the latch from the draw-in position to the standby position. When the latch is switched from the standby position to the draw-in position, due to the urging force which has been accumulated in the urging device, the slide assist mechanism allows the moving body to move from the first position to the second position on the main body side through the operation member. The slide assist mechanism includes a control device which is provided between the latch and the slider, and when the latch is switched between the standby position and the draw-in position through the operation member, the control device prevents the latch from inclining relative to the slider so as to maintain a horizontal rotational movement of the latch.

Further preferably, the present invention is realized as follows.

(A) The control device comprises an arc-like supporting groove provided in the slider and notched as a center of a pivotal supporting portion for the latch; and a supporting shaft for suspending which includes a neck portion provided in the latch and inserted to pass through the supporting groove freely slidably, and a head portion retaining the neck portion in a state wherein the neck portion is inserted to pass through the guide groove. In this case, as the control device, the latch is supported in a suspending state through the supporting shaft without damaging a rotation of the latch relative to the supporting groove on a slider side so as to be capable of maintaining a horizontal rotation of the latch with a simplified structure.

(B) The control device comprises a collar portion provided in a shaft portion rotatably supporting the latch to the slider, and projecting around a shaft; and a level difference provided in the slider and fitted in the collar portion. In this case, the control device comprises the collar portion projecting around the shaft of the shaft portion by using the shaft portion rotatably supporting the latch to the slider; and the level difference provided in the slider and fitted in the collar portion so as to be capable of maintaining the horizontal rotation of the latch with the simplified structure.

(C) The control device comprises an abutting piece projecting upward from one portion of the latch, and contacting freely slidably with a corresponding portion of the slider. In this case, the control device comprises the abutting piece projecting upward from one portion of the latch, and contacting freely slidably with the corresponding portion of the slider, so that the horizontal rotation of the latch is allowed to be maintained with the simplified structure.

According to the third aspect of the present invention, the draw-in unit used in the slide assist mechanism according to the first or the second aspect of the present invention is provided.

Incidentally, the aforementioned moving body includes a drawer and the like in addition to a sliding door. The main body includes a frame for the sliding door, a housing portion for the drawer, and the like. The first position shows a complete closed position or a complete open position of the moving body, and also includes the closed position wherein the moving body is completely pushed in the housing portion, or the open position wherein the moving body is completely pulled out. The second position shows the complete opened position or the complete closed position of the moving body, and also includes the open position wherein the moving body is completely pulled out of the housing portion, or the closed position wherein the moving body is completely pushed into the housing portion.

Effect of the Invention

As for the slide assist mechanism according to the first aspect of the present invention, in the slider, the urging device is disposed on the lower surface side, and one end in the sliding direction includes the attachment device for the urging device, so that even in a case where the coil spring whose entire size is long is used as the urging device, the slide assist mechanism of the present invention allows to easily prevent from buffering with the latch so as to be capable of maintaining the simplification, the flat downsizing, and the excellent operation property.

As for the slide assist mechanism according to the second aspect of the present invention, when the latch is switched between the standby position and the draw-in position through the operation member on a moving body side, due to the control device provided between the latch and the slider, the horizontal rotation relative to the slider is maintained to prevent from oscillating or inclining. Thereby, in the present invention, as in the case of an embodiment, even in a case where the coil spring (the coil spring with a length corresponding to a length between a left end of a left-side slider and a right end of a right-side slider in a state wherein the urging force is released) whose entire size is the longest is used as the urging device, since the control device for the latch is provided between the latch and the slider, even if the guide device (for example, the projection on a lower surface of the latch, and the guide groove on a lower surface of the case) provided between the latch and the lower surface of the case shown, for example, in the Patent Document 1 is omitted, a position switchover of the latch is allowed to be maintained stably and assuredly so as to be capable of improving the operation property.

The draw-in unit according to the third aspect of the present invention becomes useful in obtaining advantages of the slide assist mechanism.

BRIEF DESCRIPTION OF THE DRAWINGS

FIG. 2(*b*) is an enlarged view of a portion A in FIG. 2(*a*); and FIG. 2(*c*) is a cross-sectional view taken along a line F-F in FIG. 2(*b*).

FIG. 3(*b*) is a cross-sectional view taken along a line C-C in FIG. 2(*a*); FIG. 3(*c*) is a cross-sectional view taken along a line D-D in FIG. 2(*a*); and FIG. 3(*d*) is a cross-sectional view taken along a line E-E in FIG. 2(*a*).

FIG. 7(*a*) is a schematic perspective view wherein the slider is viewed from the upper side; and FIG. 7(*b*) is a schematic perspective view wherein the slider is displaced for a predetermined angle from FIG. 7(*a*).

FIG. 8(*a*) is a schematic perspective view wherein the slider is viewed from the upper side; and FIG. 8(*b*) is a schematic perspective view wherein the slider is displaced for the predetermined angle from FIG. 8(*a*).

FIG. 9(*a*) is a top view; FIG. 9(*b*) is a front view; FIG. 9(*c*) is a bottom view; and FIG. 9(*d*) is a cross sectional view taken along a line G-G in FIG. 9(*a*).

FIGS. 10(*a*) and 10(*b*) are pattern diagrams showing a relation of each member in a standby position of the latch; FIG. 10(*c*) is a pattern diagram showing the operation in a state wherein the latch has been switched from the standby position to a draw-in position; and FIG. 10(*d*) is a pattern diagram showing a process wherein an urging force is being accumulated in an urging device.

FIG. 12(*a*) is a structural view of the draw-in unit; and FIG. 12(*b*) is a substantial operational view thereof.

BEST MODES OF CARRYING OUT THE INVENTION

Figure 1:
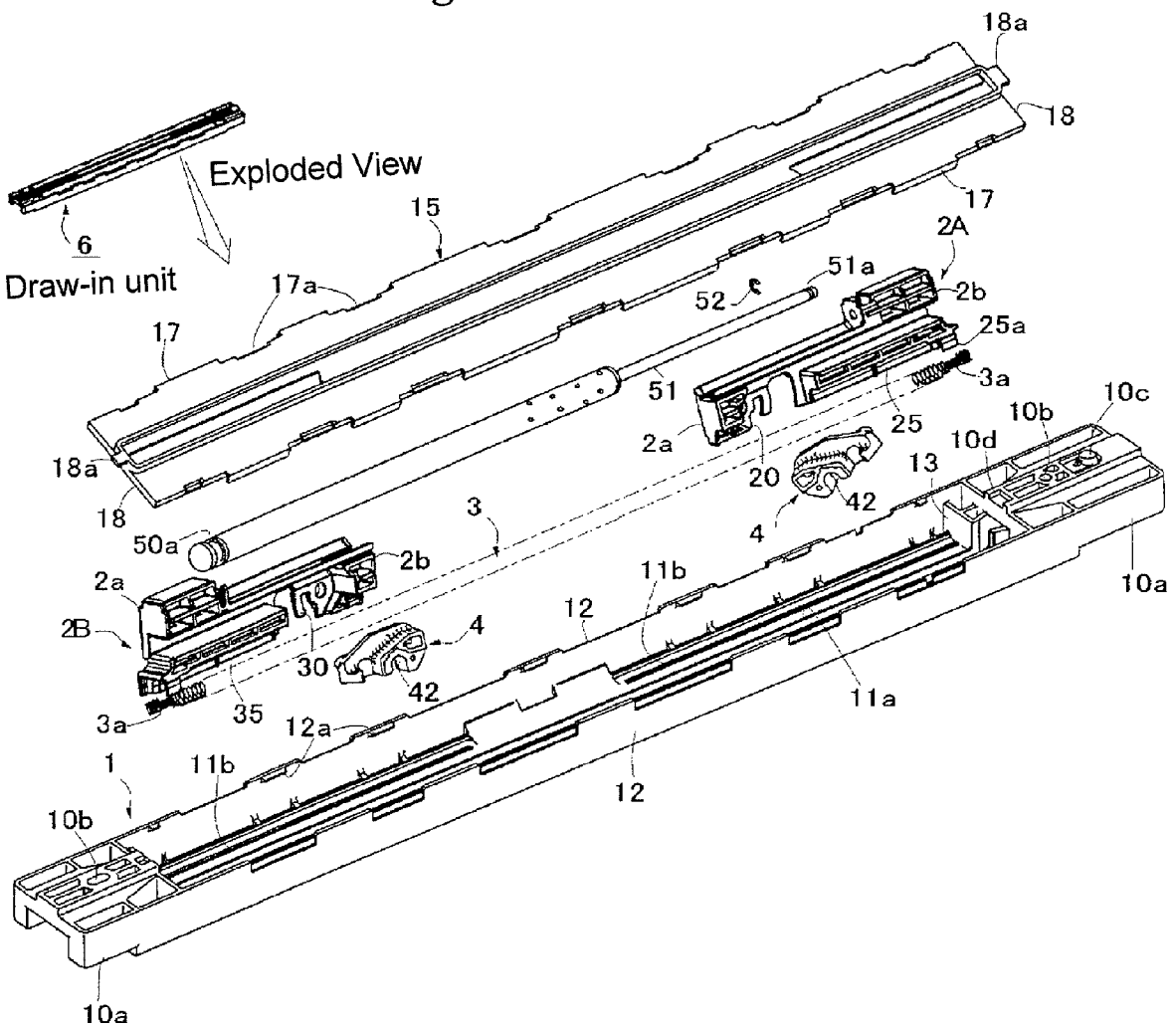
FIG. 1 is an exploded structural view showing a draw-in unit which is an essential portion of a slide assist mechanism of an embodiment.
Figure 2A:
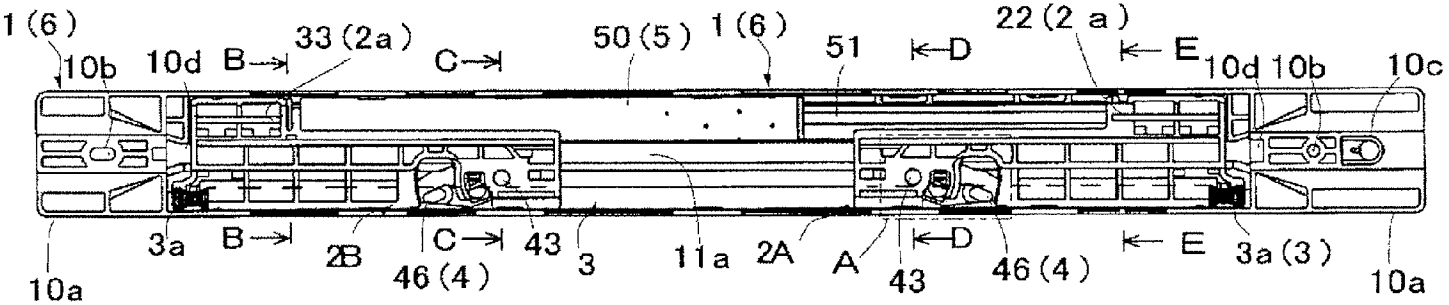
FIG. 2(*a*) is a plan view in a state wherein a cover is removed from the draw-in unit.
Figure 2C:
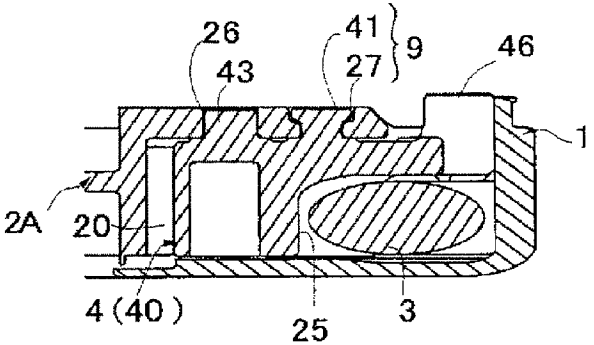
Figure 2B:
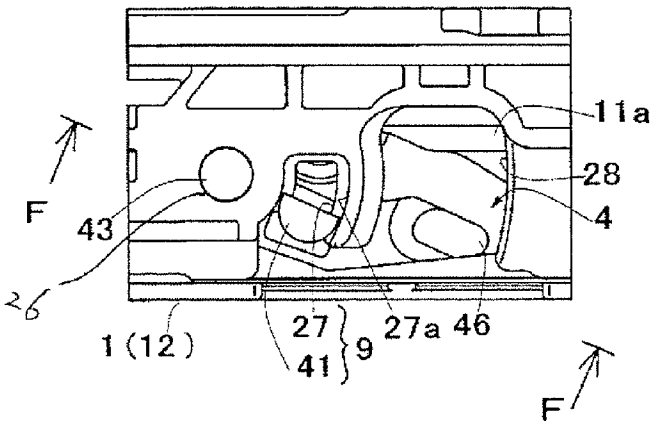
Figure 3A:
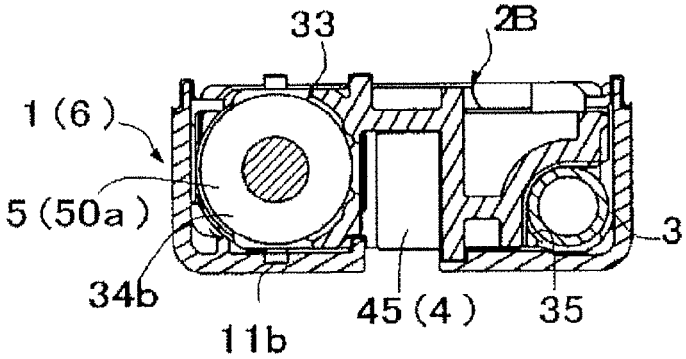
FIG. 3(*a*) is a cross sectional view taken along a line B-B in FIG. 2(*a*)
Figure 3B:
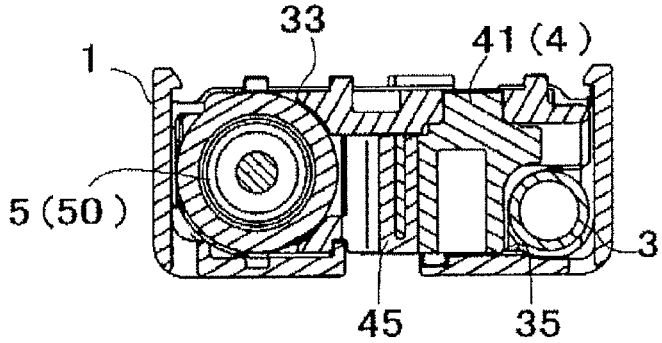
Figure 3C:
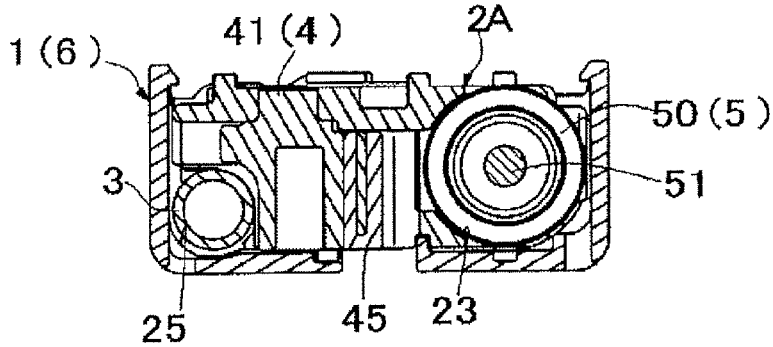
Figure 3D:
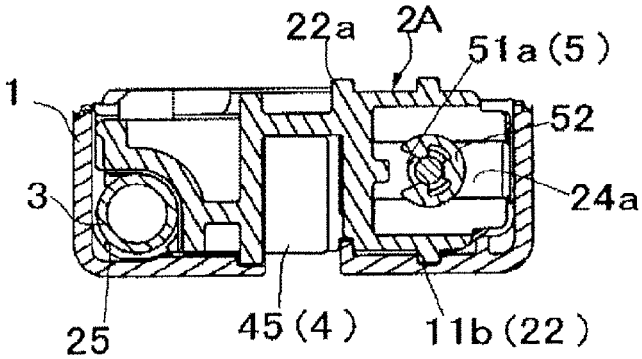
Figure 4A:
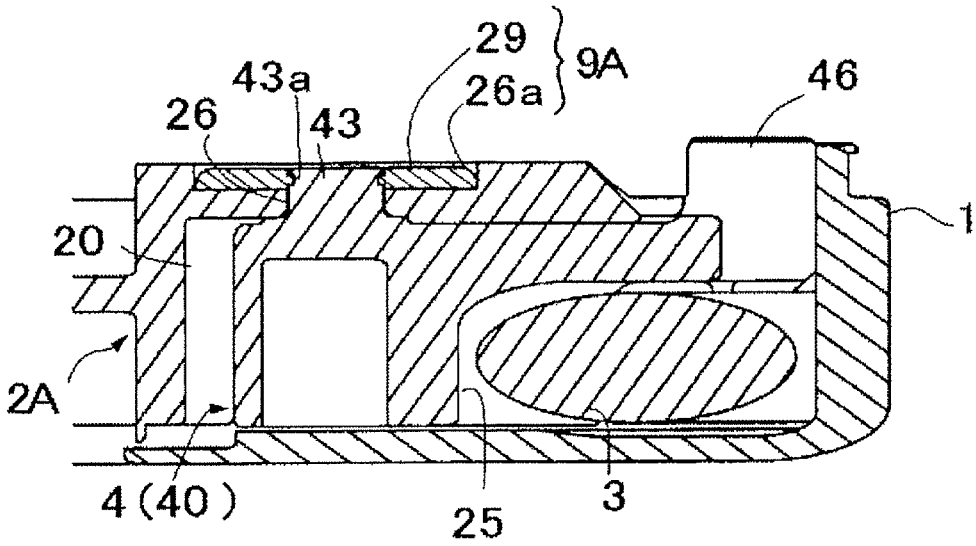
FIG. 4(*a*) is an enlarged cross-sectional view showing a modified example 1 with an illustrative embodiment of FIG. 2(*c*), and FIG. 4(*b*) is an enlarged cross-sectional view showing a modified example 2 with a similar illustrative embodiment.
Figure 4B:
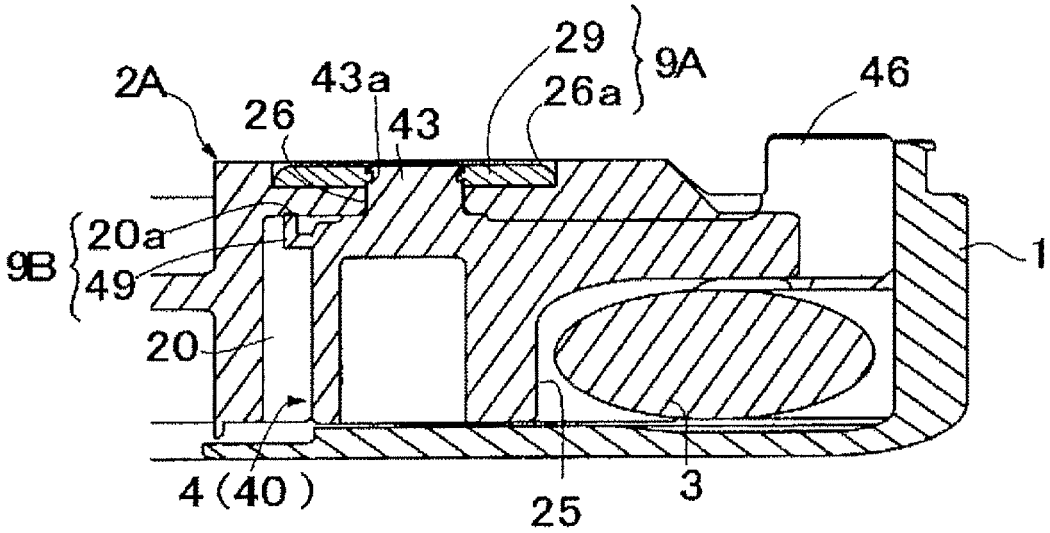
Figure 5:
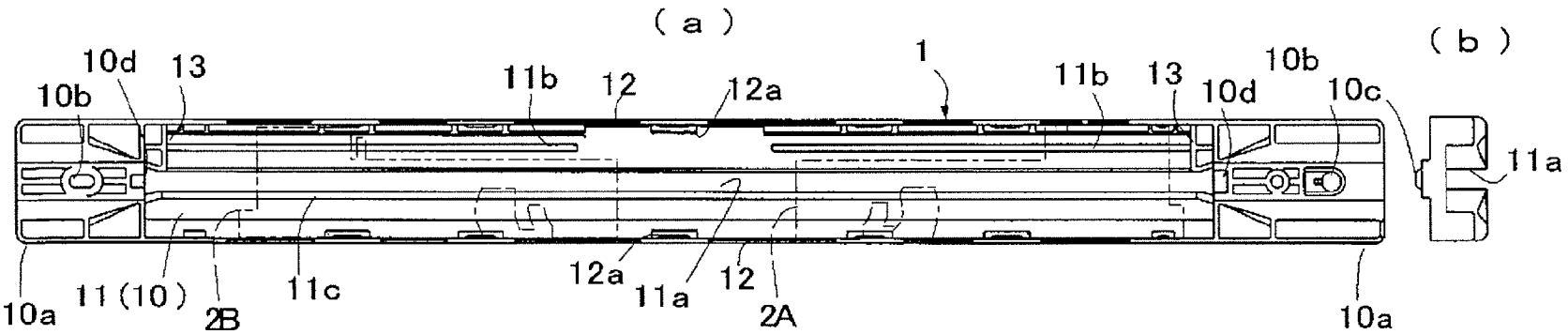
FIG. 5(*a*) is a plan view wherein a case is viewed from an upper side, and FIG. 5(*b*) is a side view thereof.
Figure 6:
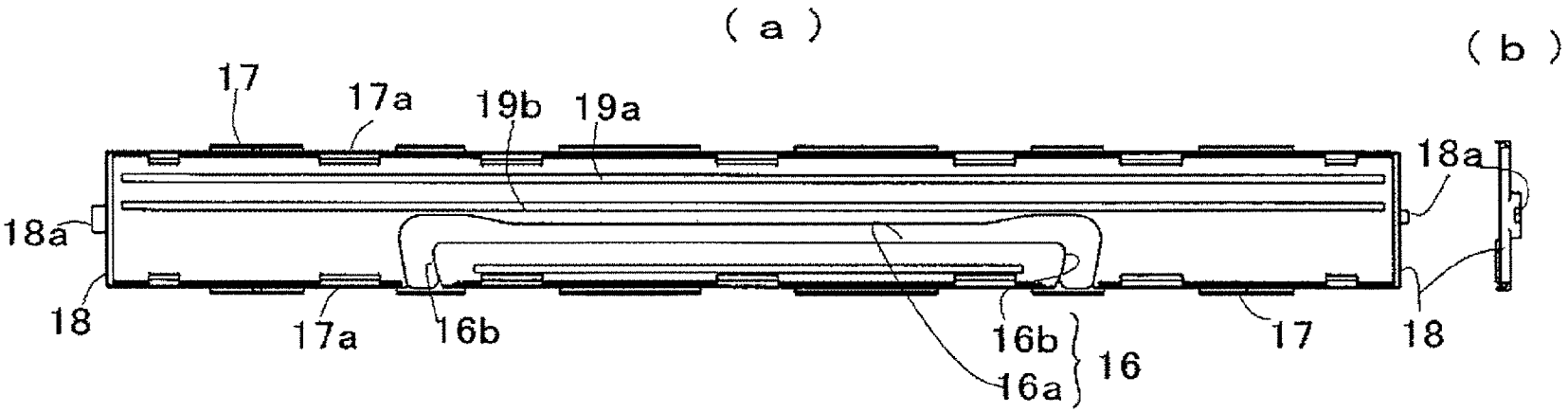
FIG. 6(*a*) is a bottom view wherein the cover is viewed from a lower side, and FIG. 6(*b*) is a side view thereof.
Figure 11A:
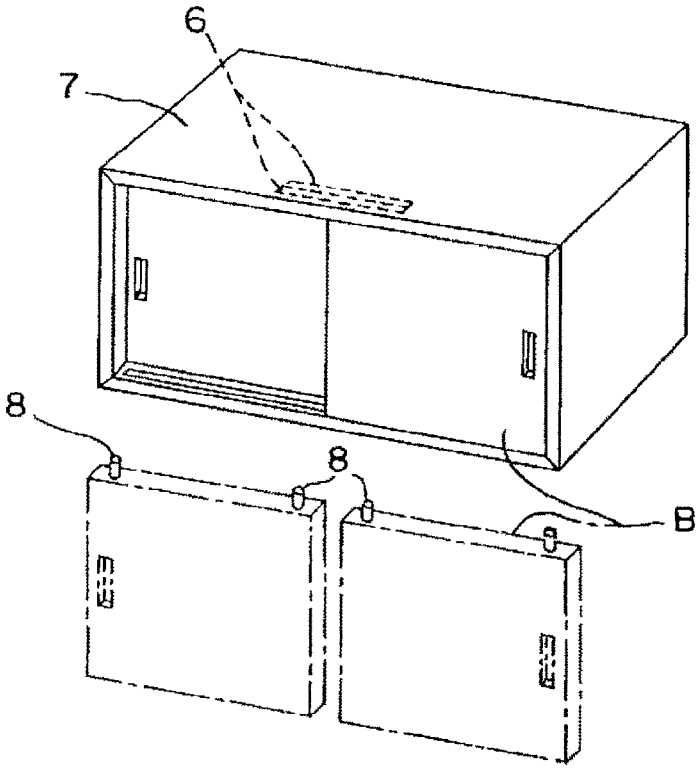
FIG. 11(*a*) shows a specific example of a main body and a moving body, and FIG. 11(*b*) shows a constituent example of an operation member, as an example of the application of the draw-in unit.
Figure 11B:
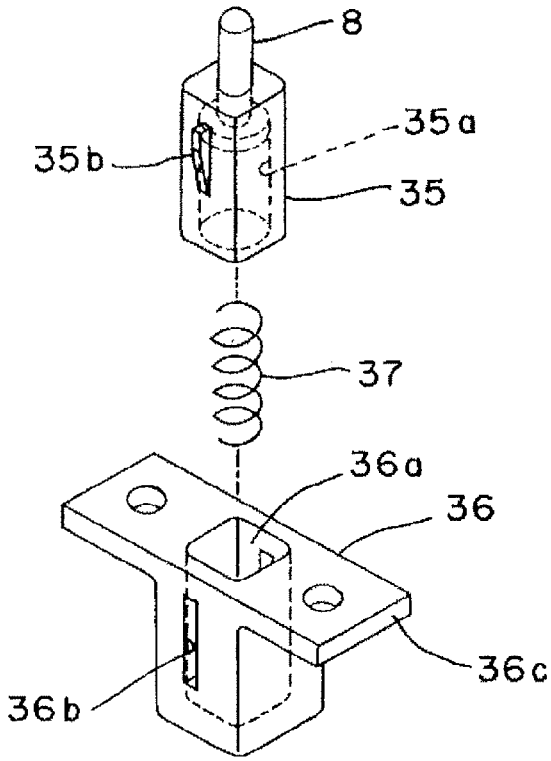

Embodiments of the present invention will be explained with reference to drawings. FIG. 1 shows an overall structure of a draw-in unit which is a main portion of a slide assist mechanism. FIGS. 2(*a*) to 2(*c*), and FIGS. 3(*a*) to 3(*d*) show details of an inside of the draw-in unit. FIGS. 4(*a*) and 4(*b*) show modified examples of essential portions. FIGS. 5(*a*) to 9(*d*) show detailed portions of constituent members. FIGS. 10(*a*) to 10(*d*) show operations of the essential portions. FIGS. 11(*a*) and 11(*b*) show a usage example and a constituent example of an operation member. Incidentally, one portion of the drawings are omitted or simplified for reasons of a construction of the drawings. Hereinafter, mechanism characteristics, the draw-in unit, the operation member, assembly, the operations, and the modified examples will be explained in detail in that order.

(Mechanism characteristics) The slide assist mechanism of the embodiment comprises a draw-in unit 6 attached to one of a main body 7 or a sliding door as a moving body; and projection bodies 8 which are the operation member attached to another of the main body 7 or the sliding door. In the following embodiment, there is shown a case wherein the draw-in unit 6 is attached to the main body 7, and the projection bodies 8 are attached to a sliding door A (B). However, the draw-in unit 6 can be attached to the sliding door A (B), and the projection bodies 8 can be attached to the main body 7. Also, the draw-in unit 6 and the projection bodies 8 are broadly divided into three kinds of the following structures by the moving body for an object or draw-in operation setting.

The first structure is in a case in which the draw-in unit 6 shown in FIGS. 1 to 4(*b*), and two projection bodies 8 are used as a pair. The draw-in unit 6 is disposed in a case 1, and comprises a pair of sliders 2A and 2B which is slid in a direction mutually approaching and separating; an urging device 3 urging both the sliders 2A and 2B in a direction of approaching; a braking device 5 braking a sliding speed of each slider 2A and 2B; and a pair of latches 4 and 4 rotatably supported respectively by each slider 2A and 2B, and releasably locked in corresponding portions inside the case 1 so as to be capable of holding both the sliders 2A and 2B in a separated state. The essential portions are provided between the latches 4 and 4, and the sliders 2A and 2B. When a standby position wherein the latches 4 and 4 are locked in the corresponding portions (locking grooves 16*b* of a guide groove 16) through the projection bodies 8, and a draw-in position wherein the aforementioned locking is released, are switched over, the essential portions include a control device 9 which maintains a horizontal rotational movement of the latches relative to the sliders 2A and 2B. Also, a draw-in structure is when one of the sliding doors A and B in FIG. 11(*a*) as the moving body; for example, the sliding door A is slid relative to a corresponding opening portion of the main body 7. When the sliding door A is moved up to a middle of a movement in an opening direction from a closed position, and up to a middle in a closing direction from an open position, the rest is set to move up to the open position or the closed position due to an urging force of the urging device 3.

Figure 12A:
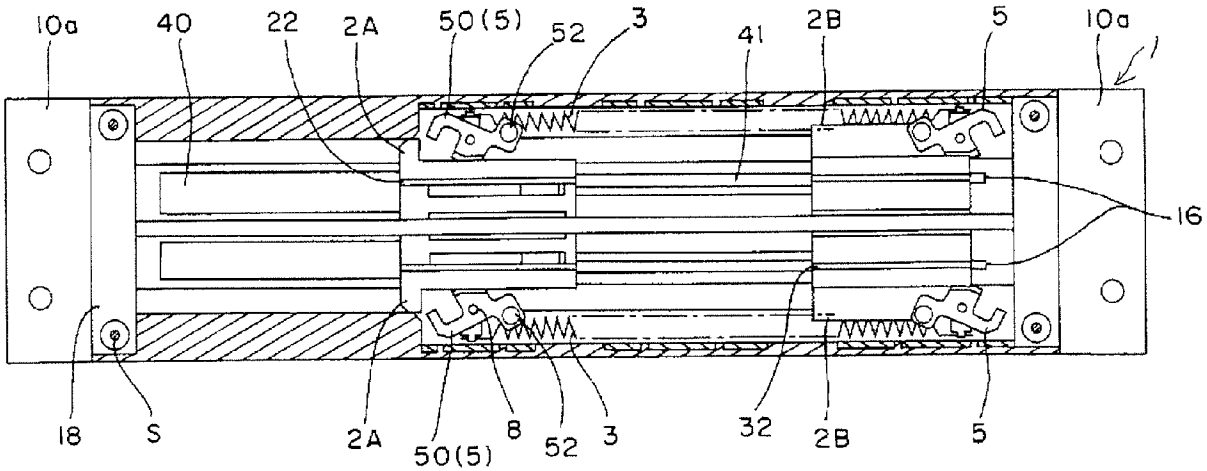
FIGS. 12(*a*) and 12(*b*) show a slide assist mechanism of the Patent Document 1.
Figure 12B:
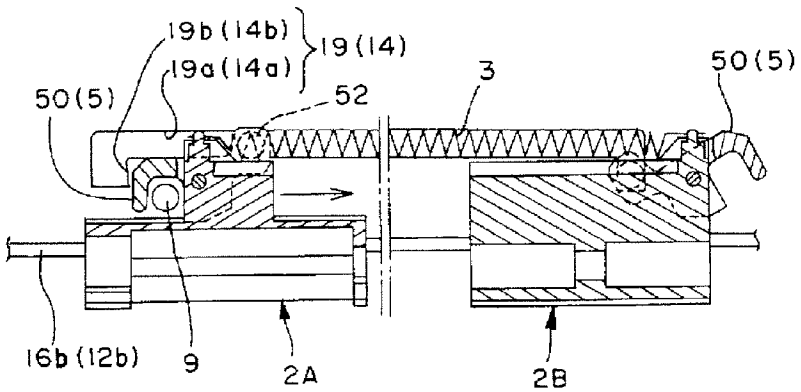

A second structure is in a case in which the sliding doors A and B in FIG. 11(*a*) as the moving body are respectively slid relative to the corresponding opening portion of the main body 7. In the same figure, two draw-in units 6 and a total of four projection bodies 8 are used as a pair. However, alternatively, as shown in FIGS. 12(*a*) and 12(*b*), constituent members of the draw-in unit 6 corresponding to the sliding door A and the draw-in unit 6 corresponding to the sliding door B, are assembled to a shared case. Specifically, the draw-in unit has a structure in which, as a unit of a pair of the sliders 2A and 2B which is slid in the direction mutually approaching and separating; the urging device 3 urging both the sliders 2A and 2B in the direction of approaching; the braking device 5 braking the sliding speed of each slider 2A and 2B; and a pair of the latches 4 and 4 pivotally supported respectively at each slider 2A and 2B, and also releasably locked in a case 1 side so as to be capable of holding both the sliders 2A and 2B in the separated state, the two pairs are disposed relative to the same case. Since an explanation thereof can be easily imagined from the embodiment, the explanation is omitted.

A third structure is in a case in which the moving body is drawn in only in one direction. For example, in FIG. 2(*a*), the draw-in unit becomes the most simplified structure in which one of the sliders 2A and 2B is omitted; one end of a coil spring which is the urging device 3 is locked in the slider, and also another end of the coil spring is locked in a case side; and one end of the braking device 5 is locked in the slider, and also another end of the braking device 5 is locked in the case side. Since an explanation thereof can be also easily imagined from the embodiment, the explanation is omitted.

(Draw-in unit) Detailed portions of the draw-in unit 6 will be demonstrated. As shown in FIGS. 1, 5(*a*), and 5(*b*), the case 1 integrally forms a space portion 10 whose upper side is open; and attachment portions 10*a* to a main body side which project to right and left of the space portion 10. The case 1 includes a cover 15 closing the space portion 10. The space portion 10 has a slender and short form of a container shape, and is divided by a lower surface 11, both-side surfaces 12, and right-and-left end portions. The reference numeral 13 represents the end portions dividing an inner piece side of the space portion 10. In the lower surface 11, there are provided a guide hole 11*a* positioned at a middle of the width and extending to right and left; slider guide grooves 11*b* which are divided into right and left and also whose cross-sectional surface has an approximately concave shape; and a slider guide groove 11*c* which has an approximately L-shaped level difference along a one-side edge portion of the guide hole 11*a*.

The cover 15 includes an approximately concave-like guide groove 19*a* facing the guide grooves 11*b*; an approximately concave-like guide groove 19*b* approaching the guide groove 19*a* and provided to line up in the same direction; an approximately concave-like latch guide portion provided at a middle of the right and left; and an approximately concave-like guide groove 19*c* extending to right and left inside the guide portion 16. The guide portion 16 comprises a straight-line groove 16*a* extending to right and left between the guide groove 19*b* and the guide groove 19*c*; and approximately L-shaped locking grooves 16*b* provided on both sides of the straight-line groove 16*a*.

On the both-side surfaces 12 on the case side and both sides 17 on a cover side, there are provided hook-like locking portions 12*a* and hole-like engaging portions 17*a* mutually engaging when the cover 15 is disposed in the space portion 10, as a plural pair. Also, on the attachment portions 10*a* on the case side and right-and-left end surfaces 18 on the cover side, there are provided concave-like locking portions 10*d* and convex-like engaging pieces 18*a* mutually engaging when the cover 15 is disposed in the space portion 10. Then, in the example, the cover 15 is placed in the case 1 through the aforementioned engagements. The right-and-left attachment portions 10*a* have a cross-sectional surface of a reversed concave shape in a width direction, and the projection bodies are slidable along the guide hole 11*a* from a reversed concave-like portion thereof.

Figure 7A:
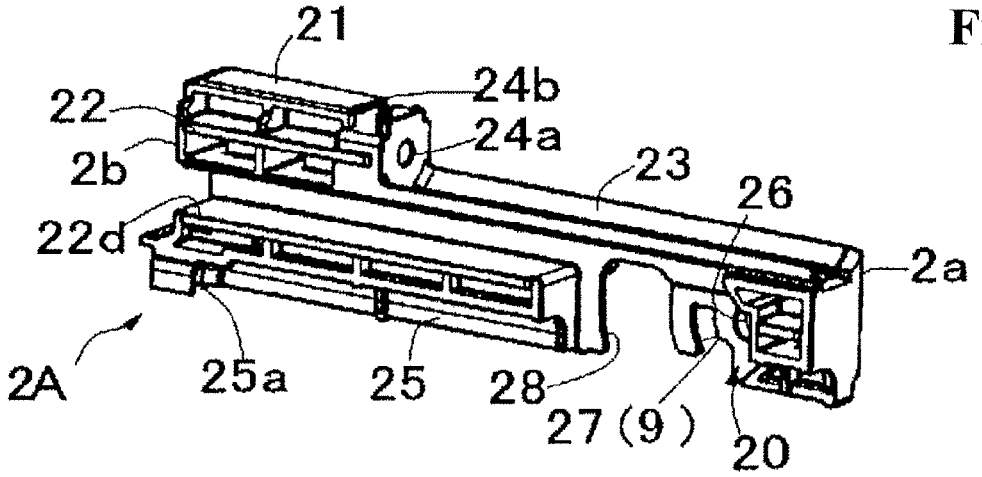
FIGS. 7(*a*) and 7(*b*) show one slider.
Figure 7B:
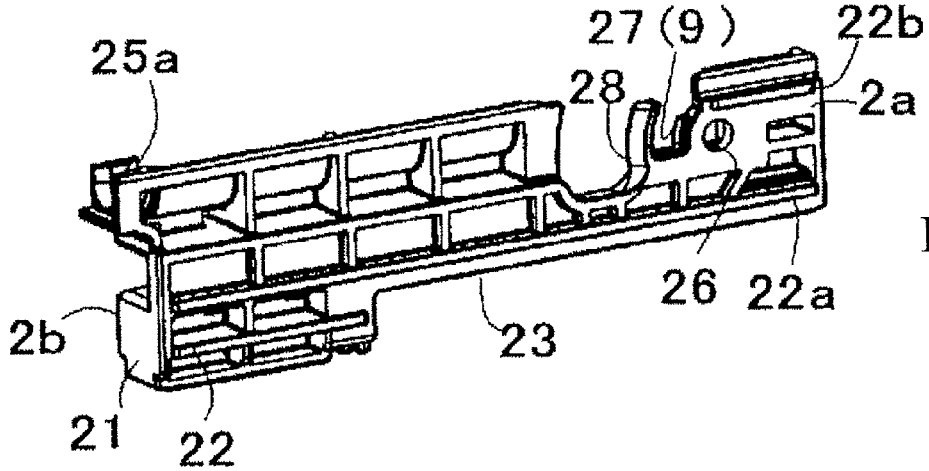

The sliders 2A and 2B have a resin block shape, and as shown in FIGS. 7(*a*) to 8(*b*), the sliders 2A and 2B are disposed in a space between the lower surface 11 on the case side and the cover 15. In the example, as described hereinafter, due to a relation wherein a piston-type damper is used as the braking device 5, the sliders 2A and 2B have a different shape. However, in a case where a rotary-type damper is used as the braking device, the sliders 2A and 2B are allowed to have the same shape.

The slider 2A and the slider 2B have the following respects in common. Connecting portions 21 and 31 for the braking device form one portion of upper and lower surfaces 2*a* and 2*b*, or 3*a* and 3*b*, and also include a convex portion 22 or 32 provided in the upper and lower surfaces 2*a* and 2*b* and the upper and lower surfaces 3*a* and 3*b*, and extending to right and left. There are included guide portions 23 and 33 whose cross-sectional surface is arc-like provided in parallel to one side, i.e., a connecting portion side so as to guide the braking device 5; and spring placement portions 25 and 35 provided along a longitudinal direction on a lower surface side on the another side. There is included a concave-like latch-and-hold portion 25*a* or 35*a* provided in one end side of each spring placement portion 25 and 35, and locking a corresponding end portion of the coil spring which is the urging device 3. There are included latch placement portions 20 and 30 positioned on sides of the spring placement portions 25 and 35, and forming one portion of the lower side in the reversed concave shape. There are included escape grooves 28 and 38 which divide each latch placement portion 20 and 30 and are provided in upper wall portions; supporting grooves 27 and 37; and shaft holes 26 and 36 for pivotally supporting.

Here, the connecting portion 21 includes an insertion hole 24*a* provided in an inner end surface, and an escape portion 24*b* notched from an outside. On the other hand, the connecting portion 31 includes an approximately U-shaped clamp portion 34*a* provided by maintaining a gap 34*b* between the clamp portion 34*a* and the inner end surface. Also, in the latch placement portions 20 and 30, the shaft holes 26 and 36 are provided on an angle portion side which is off the center, and pass through up and down. As shown in FIG. 2(*b*), the supporting grooves 27 and 37 are positioned on a concentric circle with the shaft holes 26 and 36, are notched in an arc shape, and also include a level difference 27*a* which becomes a receiving surface provided along an upper edge. The escape grooves 28 and 38 have an opening larger than the supporting groove 37.

As shown in FIGS. 2(*a*) to 2(*c*), in the latches 4, the latch used for the slider 2A, and the latch used for the slider 2B have a symmetric shape. FIGS. 9(*a*) to 9(*d*) show the latch on a slider 2A side. To explain this with reference to the same figures, the latch 4 is a resin molded body having a thickness so as to be housed in the latch placement portions 20 and 30 with plenty of room. The latch 4 integrally forms a supporting portion 40 pivotally supporting at a slider side; an engaging portion 42 at a normal time, provided in one side of the supporting portion 40, and engaging with and disengaging from the projection bodies 8 which are the operation member;

and an assist engaging device 47 positioned on a lower surface side of the latch, and provided on an end 45 side relative to the engaging portion 42.

The supporting portion 40 includes a shaft portion 43 for pivotally supporting which is positioned on an upper surface side and provided to be projected on an end portion side; a supporting shaft 41 for suspending which is provided to be projected near the center; and a projection 46 which is provided to be projected on the end portion side separated from the shaft portion 43. The shaft portion 43 is fitted in the shaft hole 26 or 36 on the slider side, so that the latch 4 is rotatably assembled relative to the slider 2A or 2B. The supporting shaft 41 constitutes the control device 9 of the present invention together with the supporting groove 37, and includes a neck portion 41*a* inserted to pass through the supporting groove 37 to freely slide; and a head portion 41*b* retaining the neck portion 41*a* in a state wherein the neck portion 41*a* is inserted to pass through the supporting groove 37. The projection 46 is formed higher than the shaft portion 43 and the supporting shaft 41. In a state wherein the latch 4 is pivotally supported at each slider rotatably, the projection 46 is fitted in the guide portion 16 on the cover side; slides along the straight-line groove 16*a*; and engages the locking grooves 16*b* so as to lock the sliding of the latch 4 (and the slider).

The assist engaging device 47 engages the projection body 8 when the latch 4 comes to the draw-in position in a non-engagement state due to an improper operation so as to allow the latch 4 to be switched from the draw-in position to the standby position. In the example, the assist engaging device 47 comprises an inclined-surface guide portion 45*a* on an end side which is made to have a level difference whose end side is broadly depressed at the lower surface side of the latch, and guides the projection body 8; and a concave portion 47 continuing into the inclined-surface guide portion 45*a*, and deepening one step. The inclined-surface guide portion 45*a* is a taper whose end becomes lower. In a usage illustrative embodiment, when the projection body 8 abuts against the inclined-surface guide portion 45*a* upwardly, the projection body 8 slides while reducing a projecting amount, and when the projection body 8 enters the concave portion 47, the projection body 8 increases the projecting amount again so as to maintain an engagement with the concave portion 47. Also, in the latch 4, a portion C forming the engaging portion 42 comprises a material different from portions except for the portion C. Specifically, the latch 4 is molded in a two-color molding method, and latch aggregate (the portions except for the portion C) is a hard resin portion formed by primary molding, and the portion C forming the engaging portion 42 is a soft resin portion formed by secondary molding. This is because when the projection body 8 bumps into a U-shaped corresponding portion of the engaging portion 42, a noise tends to be generated easily. However, by constituting the U-shaped corresponding portion by the soft resin portion, the generation of that kind of hitting sound can be prevented. Regarding the detailed portions, see Japanese Unexamined Patent Publication No. 2008-149908.

A compression coil spring is used for the urging device 3. A whole size of the spring is nearly equal to a sum of a length of the slider 2A and the slider 2B in a state wherein the urging force is released. By lengthening the spring to its fullest extent, a spring property is allowed to be provided excellently. On both ends, there are provided radius-small-spiral spring portions 3*a* for attaching.

The piston-type damper is used for the braking device 5. For the piston-type damper, the heretofore known piston-type damper (for example, Japanese Unexamined Patent Publication No. 2006-29564 and the like) may be used provided that the piston-type damper includes a cylinder 50 and a piston rod 51 which gently comes in and out of the cylinder 50, and has a structure that the piston rod 51 is gently driven relative to the fixed cylinder 50, or the cylinder 50 is gently driven relative to the fixed piston rod 51. Also, as shown in FIG. 1, the cylinder 50 includes a neck-like locking groove 50*a* on an outer circumference at a back end, and the piston rod 51 includes a neck-like locking groove 51*a* on an outer circumference at a front end.

(Operation member) FIG. 11(*b*) shows a specific example of the projection body 8 which is the operation member. The projection body 8 has a structure so as to be capable of freely coming in and out relative to the sliding door A (B) which is the moving body through the urging force, i.e., so as to reduce the projecting amount against the urging force when a load is received. A whole structure includes the projection body 8; a supporting portion 35 having a cylinder shape with a bottom; an urging spring 37; and a holding member 36. Among those, the projection body 8 is provided to be projected on an upper end surface of the supporting portion 35. The supporting portion 35 has a cavity 35*a* whose inside places the urging spring 37, and also comprises a convex portion 35*b* so as to be projected on an opposing lateral surface. The holding member 36 has a cylinder shape with a bottom, comprises an attachment portion 36*c* so as to be projected around the top of the cylinder, and also forms a hole portion 36*b* on an opposing lateral surface. Then, in a state wherein the urging spring 37 is disposed inside the supporting portion 35, the supporting portion 35 is pushed into a hole portion 36*a* of the holding member 36, and the convex portion 35*b* is engaged with the hole portion 36*b*, so that the supporting portion 35 is retained relative to the holding member 36. In the assembled state, the projection body 8 is projected to its fullest extent relative to the holding member 36 together with the supporting portion 35 due to an urging force of the urging spring 37, and for example, if the projection body 8 receives a downward load, the projection body 8 reduces the projecting amount against the urging force of the urging spring 37. Incidentally, the projection body 8 of the present invention may have a structure of a guide shaft disclosed in, for example, Japanese Unexamined Patent Publication No. 2007-107301, or a structure similar to that.

(Assembly) For example, after each latch 4 is pivotally supported at the sliders 2A and 2B, the aforementioned respective members are connected by disposing both the sliders 2A and 2B between the piston-type damper, which is the braking device 5, and the coil spring, which is the urging device 3. Next, the above is built in the case 1, and the cover 15 is attached to the case 1 so as to be completed as the draw-in unit 6.

First, each latch 4 is rotatably supported relative to the sliders 2A and 2B by the fitting between the shaft portion 43 and the shaft hole 26, or between the shaft portion 43 and the shaft hole 36. In the supported state, the supporting shaft 41 is supported relative to the arc-like supporting groove 27 or 37 in a suspending state, and the projection 46 is protruded to an upper surface side of the slider by passing through the escape groove 28 or 38. After that, both the sliders 2A and 2B are connected through the piston-type damper which is the braking device 5. In this case, the piston rod 51 is connected relative to the connecting portion 21 of the slider 2A in a state wherein the front end is inserted into the insertion hole 24*a*, as shown in FIG. 3(*d*), by engaging a retaining ring 52 with the locking groove 51*a* on the outer circumference in the front end of the rod from the escape portion 24*b*. The cylinder 50 is engaged with and connected to the clamp portion 34*a* relative to the connecting portion 31 of the slider 2B only by matching the aforementioned locking groove 50*a* on a cylinder side to the gap 34*b* and pressing. Also, the coil spring which is the urging device 3 is connected by operations in which the radius-small-spiral spring portions 3*a* on both end sides are respectively inserted into the concave-like latch-and-hold portion 25*a* of one slider and the concave-like latch-and-hold portion 35*a* of the another slider.

Next, the sliders 2A and 2B with the aforementioned latch 4 are disposed relative to the case 1 together with the braking device 5 and the urging device 3. In the example, as a guide device between the sliders and the case, in a state wherein a convex portion 22*d* or 32*d* on the lower surface of each slider is fitted in the guide groove 11*c* on the case side; wherein the convex portion 22 or 32 on the upper and lower surfaces of each slider is fitted in the guide grooves 11*b* on the case side and the guide groove 19*a* on the cover side; wherein a convex portion 22*a* or 32*a* on the upper surface of each slider is fitted in the guide groove 19*b* on the cover side; and wherein a convex portion 22*b* or 32*b* provided on the upper surface of each slider is fitted in the guide groove 19*c* on the cover side, i.e., at upper and lower plural portions, the sliders and the case are guided with excellent accuracy. Also, in the latch 4, the projection 46 is fitted in the guide portion 16 on the case side from the escape groove 28 of the slider, and the latch 4 is switched between the draw-in position, which is slid along the straight-line groove 16*a* accompanied by the sliding of the slider, and the standby position which is entered into the locking grooves 16*b* from the straight-line groove 16*a* so as to be locked.

Figure 8A:
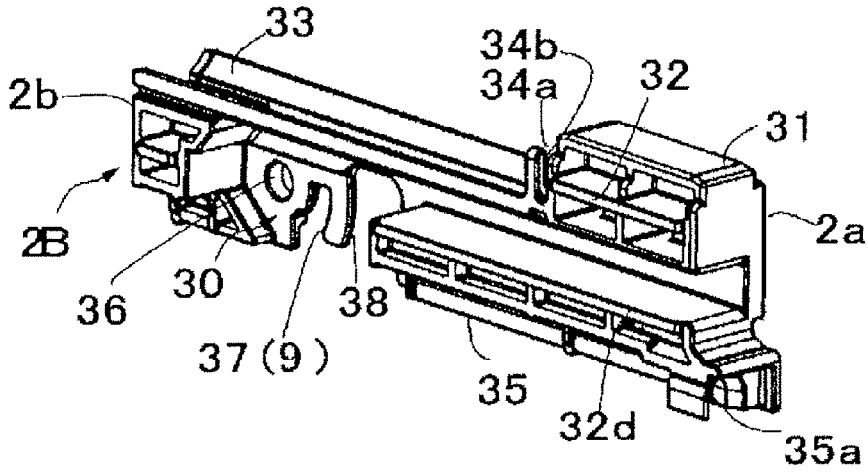
FIGS. 8(*a*) and 8(*b*) show another slider.
Figure 8B:
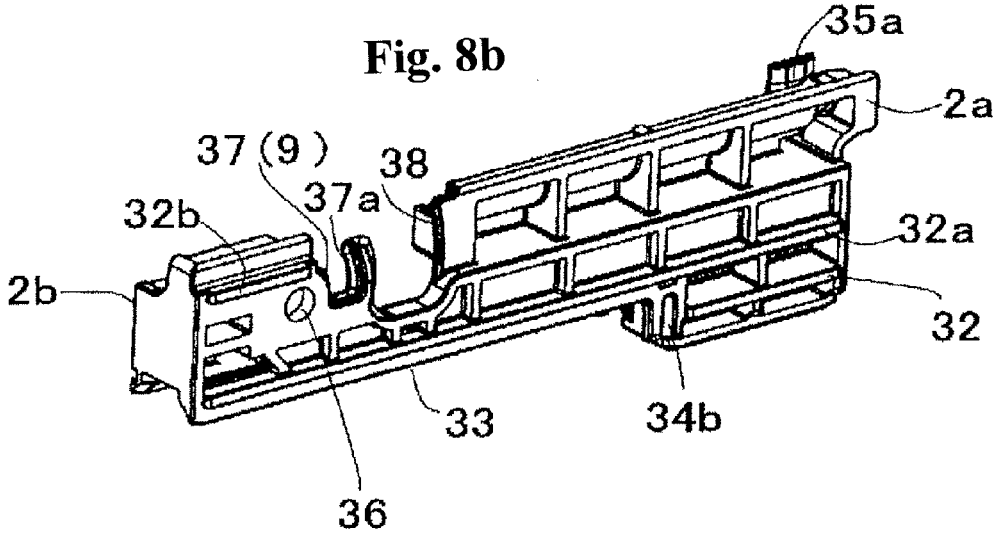
Figure 9A:
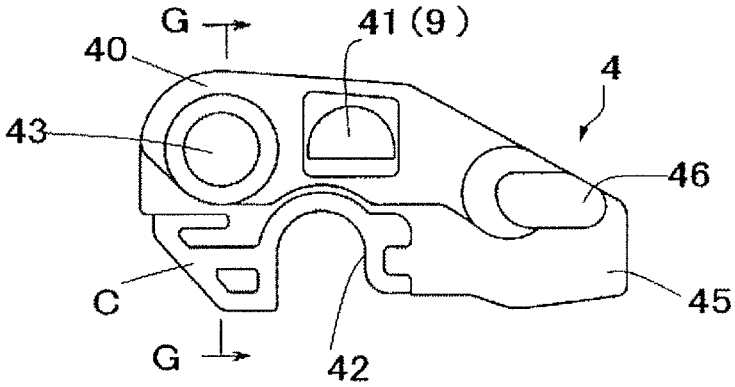
FIGS. 9(*a*) to 9(*d*) show a latch (a latch on one slider side)
Figure 9B:
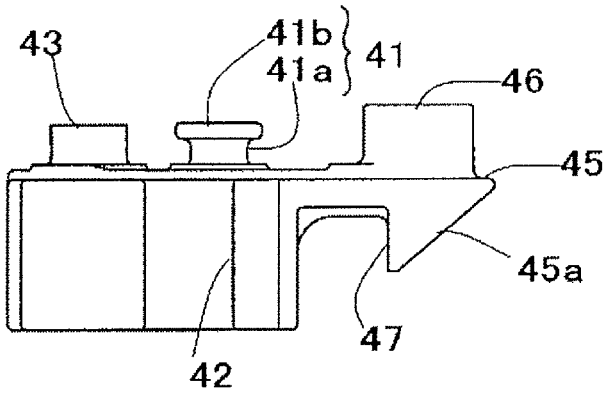
Figure 9C:
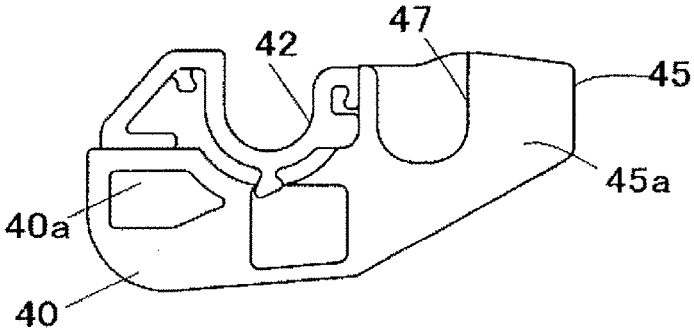
Figure 9D:
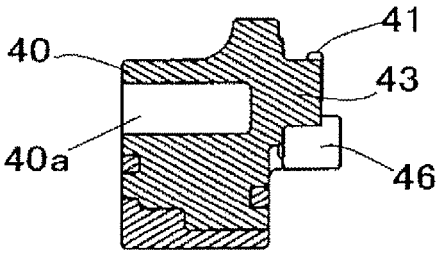
Figure 10A:
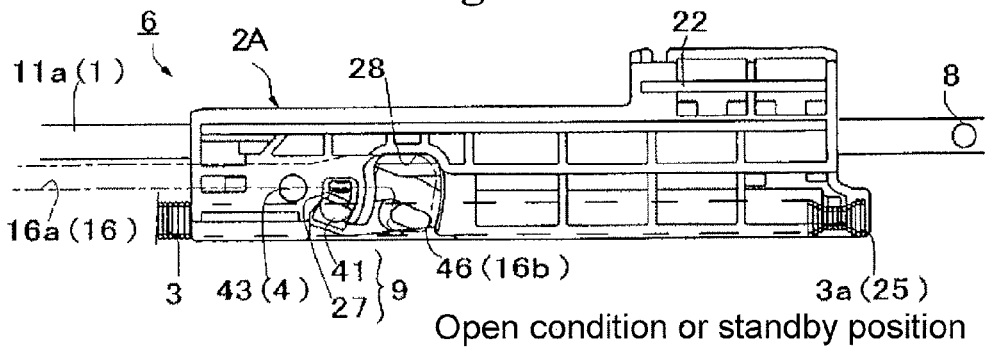
FIGS. 10(*a*) to 10(*d*) show operations of the draw-in unit.
Figure 10B:
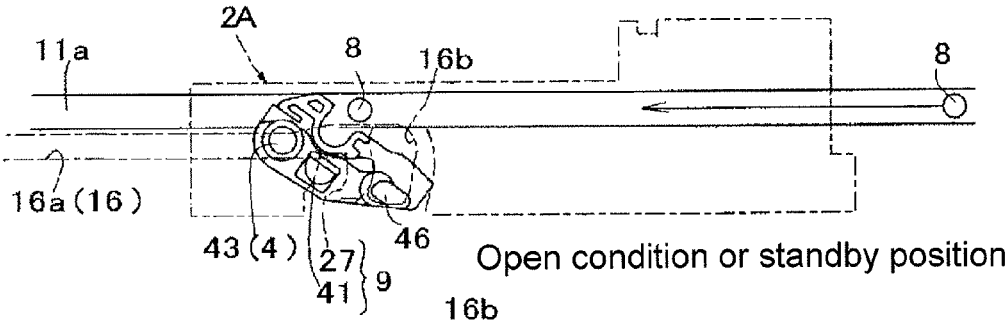
Figure 10C:
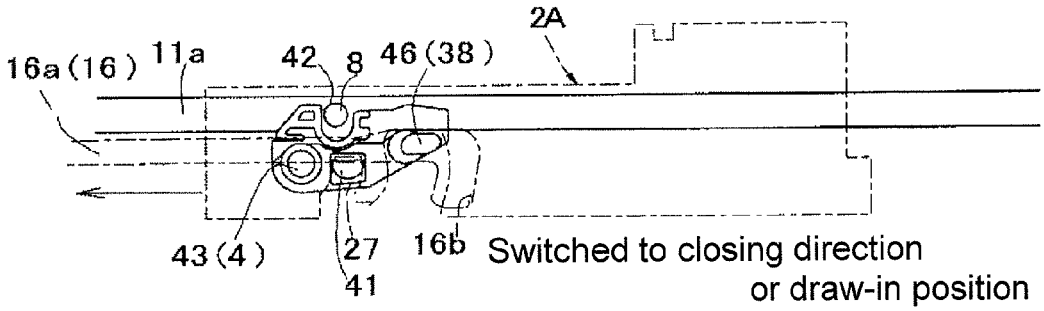
Figure 10D:
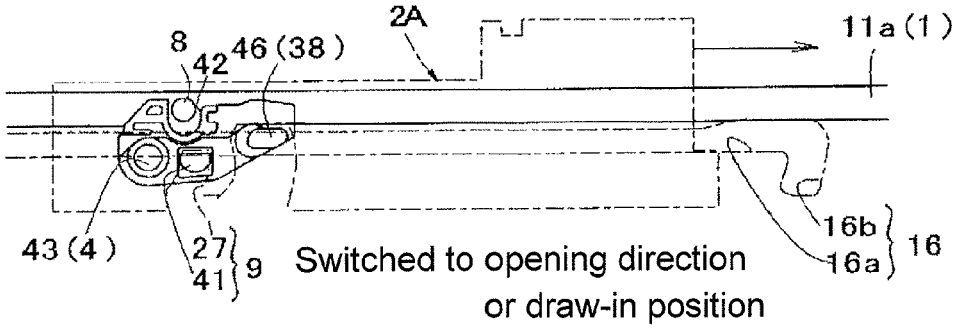

(Operation) FIGS. 10(*a*) to 10 (*d*) show the operations of the slide assist mechanism and the draw-in unit 6 in the aforementioned assembled state. Here, on the assumption that the slide assist mechanism and the draw-in unit 6 are applied to the sliding door in FIG. 8(*a*), the operations will be demonstrated.

(1) FIG. 10(*a*) shows a right-side portion in the draw-in unit 6 in FIG. 2(*a*), i.e., the stand-by position of the latch 4 together with the projection body 8 which is the operation member. FIG. 10(*b*) shows the same illustrative embodiment as FIG. 10(*a*) by using imaginary lines only for the slider 2A in order to make a relation of the members understandable. In the standby position of the latch, the coil spring which is the urging device 3 is stretched so as to accumulate the urging force. The latch 4 is locked in a corresponding portion of the case 1 in a state wherein the projection 46 is engaged with the locking grooves 16*b* on the case side so as to control the position of the slider 2A against the urging force of the urging device 3.

Incidentally, a load is applied to the latch 4 through the slider 2A due to the urging device 3, for example, when the latch 4 receives a large oscillation, the latch 4 oscillates as a supporting point of pivotal supporting portions (the shaft portion 43 and the shaft hole 26 on the slider side), and an end side which is separated from the shaft portion 43 inclines downwardly, so that there is the possibility that the projection 46 could be unlocked from the locking grooves 16*b* carelessly. As a measure for that, in the conventional mechanism in FIGS. 12(*a*) and 12(*b*), as mentioned above, the latches 5 include the projections 52 on the upper and lower surfaces, and each projection 52 is fitted in the guide grooves 14 and 19 provided on the upper and lower surfaces of the case 1. However, this measure has restrictions described in the Problems to be Solved by the Invention. On the other hand, the mechanism of the present invention includes the control device 9, and the latch 4 is supported by the supporting groove 37 on the slider side through the supporting shaft 41 in the suspending state to maintain a horizontal state so as to prevent such improper operation.

(2) FIG. 10(*c*) shows a state wherein the latch is switched to the draw-in position. As for a position switchover of the latch, when the latch 4 is in the standby position of FIG. 10(*b*), the sliding door comes to be moved leftward (the closing direction) from the right of the same figure, and the projection body 8 of the sliding door hits the corresponding portion of the engaging portion 42. Then, the latch 4 is rotated counterclockwise as the supporting point of the shaft portion 43 due to stress thereof, and the projection 46 is unlocked from the locking groove 16*b*, and fitted in the straight-line groove 16*a* so as to switch the projection body 8 to the draw-in position engaging the engaging portion 42. Then, the slider 2A is drawn in to a slider 2B side together with the latch 4 due to the urging force of the urging device 3 so as to switch the sliding door to the closed position. In this case, in the embodiment, when the sliding door is moved by the urging force of the urging device 3, the sliding door receives the braking of the aforementioned braking device 5 so as to be gently slid.

In the aforementioned position switchover, when the latch 4 is rotated counterclockwise as the supporting point of the pivotal supporting portions (the shaft portion 43 and the shaft hole 26 on the slider side), the supporting shaft 41 is slid along the supporting groove 37 on the slider side (in a state of being received in a level difference 37*a* of the supporting groove 37), so that the control device 9 prevents the latch 4 from inclining relative to the slider 2A so as to assuredly maintain the horizontal rotational movement. Thereby, when the latch 4 is switched between the standby position and the draw-in position through the projection body 8 which is the operation member, the mechanism of the present invention prevents the possibility that the projection 46 could come off from the guide portion 16 due to an incline of the latch and the like so as to cause the improper operation. Also, even if a further long coil spring is used as the urging device 3, the mechanism of the present invention prevents from buffering with the latch, and also flat downsizing can be easily obtained.

(3) FIG. 10(*c*) is assumed to be a state wherein the sliding door is operated to slide in the opening direction from the closed position. In this process, when the sliding door is operated to move rightward from the left of the same figure, the slider 2A is slid to a right side through the projection body 8 engaged with (the engaging portion 42) of the latch 4 which has been in the draw-in position. When the sliding door is further moved to the right and, as shown in FIG. 10(*b*), reaches the locking groove 16*b* on the right side, the projection 46 engages the locking groove 14*b* while the latch 4 is rotating clockwise as the supporting point of the shaft portion 43 due to the stress when the projection body 8 slips out of the engaging portion 42, and the latch 4 is switched to the standby position.

In the aforementioned position switchover, when the latch 4 is rotated clockwise as the supporting point of the pivotal supporting portions (the shaft portion 43 and the shaft hole 26 on the slider side), the supporting shaft 41 is slid along the supporting groove 37 on the slider side (in the state of being received in the level difference 37*a* of the supporting groove 37), so that the control device 9 prevents the latch 4 from inclining relative to the slider 2A so as to maintain the horizontal rotational movement. Thereby, the possibility of the improper operation is also prevented. Also, in this process, the urging force is accumulated in the urging device 3. The accumulated state is maintained as long as the latch 4 is in the standby position.

Incidentally, the slide assist mechanism and the draw-in unit 6 excel in the following respects in addition to advantages by the control device 9 as mentioned above. Specifically, in a relation between the striker 2A or 2B and the latch 4, a placement portion of the latch 4 relative to the striker 2A or 2B is allowed to be set arbitrarily. As imagined from FIGS. 2(*a*) to 2(*c*) and 10(*a*) to 10(*d*), this is because the striker 2A or 2B is provided to be divided into two in a width direction; the guide portions 23 and 33, whose cross-sectional surface is arc-like and which guide the braking device 5, are provided along one side; and the spring placement portions 25 and 35, and the latch placement portions 20 and 30 are provided along the another side.

Modified Examples

FIGS. 4(*a*) and 4(*b*) show two modified examples, wherein the aforementioned control device 9 (comprising the supporting shaft 41 and the supporting groove 27) is changed, by corresponding them to FIG. 2(*c*). In the explanation, portions same as those in the aforementioned embodiment are designated by the same reference numerals and only the change will be demonstrated.

A control device 9A in FIG. 4(*a*) comprises a collar portion 29 provided around the shaft portion 43 on a latch side; and a level difference 26*a* provided on the slider side, and fitted in the collar portion 29. The collar portion 29 has a metallic washer shape, and is supported through a locking groove 43*a* provided around an end of the shaft portion 43. The level difference 26*a* has a concave shape provided as a center of the shaft hole 26 and receiving the collar portion freely slidably. Then, in the aforementioned structure, the latch 4 is integrally placed relative to a latch placement portion 40 on the slider side by pushing the collar portion 29 into the locking groove 43*a* from the end of the shaft portion after the shaft portion 43 is inserted to pass through the shaft hole 26. Consequently, in the control device 9A, when the latch 4 is rotated through the pivotal supporting portions of the shaft portion 43 and the shaft hole 26 (or the shaft hole 36), or when the latch 4 is switched between the standby position and the draw-in position through the projection body 8 which is the operation member, the latch can be prevented from inclining relative to the slider through the collar portion 29 supported so as to become one surface relative to the level difference 26*a*.

A control device 9B in FIG. 4(*b*) includes an abutting piece 49 provided to be projected upward from one portion of the latch 4, usually, from the supporting portion 40 protruding the shaft portion 43, and contacting freely slidably with a corresponding portion of the latch placement portion 40 on the slider side. The abutting piece 49 is provided in a portion which becomes a side opposite to an end 45 by sandwiching the shaft portion 43 among the supporting portion 40. Also, in the latch placement portion 40, there is provided a guide groove 20*a* sliding in a state wherein an end surface of the abutting piece 49 is contacted. Although the guide groove 20*a* is a shallow guide groove, it may be omitted. Also, in the example, the control device 9B is adopted together with the control device 9A. However, as for the slide assist mechanism or the draw-in unit 6, any one of the control devices 9, 9A, and 9B may be provided. Specifically, when the latch 4 is rotated through the pivotal supporting portions of the shaft portion 43 and the shaft hole 26 (or the shaft hole 36), or when the latch 4 is switched between the standby position and the draw-in position through the projection body 8 which is the operation member, the abutting piece 49 moves while hitting relative to the guide groove 20*a*, so that even the control device 9B can prevent the latch from inclining relative to the slider. As mentioned above, the present invention can be modified accordingly with the exception of requirements specified in claims.

All contents of the specification, claims, drawings, and abstract of Japanese Patent Applications No. 2009-149779 filed on Jun. 24, 2009 are cited in their entireties herein and are incorporated as a disclosure of the specification of the present invention.

What is claimed is:

1. A slide assist mechanism, comprising:

a case adapted to be attached to one of a main body or a moving body;

a slider disposed slidably in the case;

a latch arranged under the slider and supported by the slider switchably between a standby position where the latch is locked in a corresponding portion of the case and a draw-in position where the latch is released from a locking;

a draw-in unit comprising an urging device for urging the slider;

an operation member adapted to be attached to another of the main body or the moving body, and switching the latch from the standby position to the draw-in position, or switching the latch from the draw-in position to the standby position; and a control device provided between the latch and the slider such that the latch is suspended from the slider, wherein the control device is arranged such that when the latch is switched from the standby position to the draw-in position, due to an urging force accumulated in the urging device, the moving body is moved from a first position to a second position on a main body side through the operation member, and when the latch is switched between the standby position and the draw-in position through the operation member, the control device prevents the latch from inclining relative to the slider so as to maintain a horizontal rotational movement of the latch.

2. A slide assist mechanism according to claim 1, wherein the slider includes a supporting groove, and the latch includes a supporting shaft, which form the control device;

the supporting groove has an arc-shape groove notched in an arc shape around a pivotal center of the latch; and the supporting shaft includes a neck portion inserted laterally slidably through an entrance opening of the supporting groove, and a head portion preventing the neck portion from escaping in a state in which the neck portion is inserted through the supporting groove.

3. A slide assist mechanism according to claim 1, wherein the slider includes a shaft hole, and the latch includes a shaft portion inserted in the shaft hole, the shaft hole and the shaft portion forming the control device;

the shaft portion includes a collar portion projecting circumferentially around the shaft portion and rotatably supported on the slider; and the shaft hole includes a level difference portion fitted to the collar portion.

4. A slide assist mechanism according to claim 1, wherein the latch includes an abutting piece forming the control device; and the abutting piece projects upward from one portion of the latch and contacting freely slidably with a corresponding portion of the slider.

5. A slide assist mechanism, comprising:

a case adapted to be attached to one of a main body or a moving body;

a slider including a supporting groove and disposed slidably in the case, the supporting groove having an arc-shape notched in an arc shape;

a latch arranged under the slider and including a supporting shaft projecting upwardly to be inserted in the supporting groove, the supporting shaft having a neck portion inserted laterally slidably through an entrance opening of the supporting groove and a head portion at one end of the neck portion to prevent the neck portion from escaping in a state that the neck portion is inserted through the supporting groove, the latch being supported to the slider switchably between a standby position where the latch is locked in a corresponding portion of the case and a draw-in position where the latch is released from locking;

a draw-in unit comprising an urging device for urging the slider;

an operation member adapted to be attached to another of the main body or the moving body, and switching the latch from the standby position to the draw-in position, or switching the latch from the draw-in position to the standby position; and a control device including the supporting groove and the supporting shaft, and provided between the latch and the slider such that the latch is suspended from the slider through the supporting shaft and the supporting groove, wherein the control device is arranged such that when the latch is switched from the standby position to the draw-in position, an urging force is accumulated in the urging device, and the moving body is moved from a first position to a second position on a main body side through the operation member, and when the latch is switched between the standby position and the draw-in position through the operation member, the control device prevents the latch from inclining relative to the slider to maintain a horizontal rotational movement of the latch.

6. A slide assist mechanism according to claim 5, wherein the arc-shape groove includes a level difference portion formed along an upper edge thereof, and the head portion protrudes circumferentially from the neck portion; and the head portion is arranged on the level difference portion to support the latch on the slider such that the neck portion passes through the supporting groove.

7. A slide assist mechanism according to claim 6, wherein the latch further comprises a shaft portion formed at one end portion thereof corresponding to the pivotal center of the latch, and a projection formed on the other end portion thereof spaced from the shaft portion, the supporting shaft being arranged between the shaft portion and the projection, and the shaft portion and the projection projecting in a direction parallel to the supporting shaft; and the slider further comprises a shaft hole formed at a portion corresponding to the shaft portion such that the shaft portion is inserted therein, and an escape groove notched outside of the arc-shape groove such that the projection is laterally slidably inserted therein through an entrance opening of the arc-shape groove, the an arc-shape groove being arranged between the shaft hole and the escape groove.

8. A slide assist mechanism according to claim 7, wherein the projection has a height higher than the shaft portion and the supporting shaft relative to a projecting direction from the latch, and the escape groove has the entrance opening larger than that of the supporting groove.

9. A slide assist mechanism according to claim 8, further comprising a cover including a guide portion and attached to the case, wherein the guide portion includes a straight-line groove and locking grooves formed at two ends of the straight-line groove, and the projection is fitted in the guide portion to slide along the straight-line groove and to engage the locking grooves to lock a sliding of the latch.

10. A slide assist mechanism according to claim 7, wherein the latch includes an inclined-surface guide portion formed at a side opposite to the projection and tapered in a direction toward the other end portion, and a concave portion connecting the inclined-surface guide portion and concaving from the side opposite to the projection to engage the operation member when the latch is improperly positioned in the draw-in position.

* * * * *